US011749928B2

(12) United States Patent
Zou et al.

(10) Patent No.: US 11,749,928 B2
(45) Date of Patent: Sep. 5, 2023

(54) HOUSING FOR INSTALLING CONNECTING TERMINALS AND A CONNECTOR

(71) Applicant: Tyco Electronics (Shanghai) Co. Ltd., Shanghai (CN)

(72) Inventors: Yang (Leon) Zou, Shanghai (CN); Liming (Eric) Wang, Shanghai (CN); Tongbao (Tim) Ding, Shanghai (CN); Xinxin (Daisy) Li, Shanghai (CN); Zebin (Donnie) Tang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 17/382,826

(22) Filed: Jul. 22, 2021

(65) Prior Publication Data

US 2022/0029337 A1 Jan. 27, 2022

(30) Foreign Application Priority Data

Jul. 22, 2020 (CN) ..... 202010709154.3

(51) Int. Cl.
*H01R 13/42* (2006.01)
*H01R 13/424* (2006.01)
*H01R 13/422* (2006.01)

(52) U.S. Cl.
CPC ..... *H01R 13/424* (2013.01); *H01R 13/4226* (2013.01)

(58) Field of Classification Search
None
See application file for complete search history.

(56) References Cited

U.S. PATENT DOCUMENTS 6,086,419 A * 7/2000 Marpoe, Jr. ..... H01R 13/4226 439/680
11,283,208 B2 * 3/2022 Luo ..... B33Y 80/00

* cited by examiner

*Primary Examiner* — Ross N Gushi
(74) *Attorney, Agent, or Firm* — Barley Snyder

(57) ABSTRACT

A housing for an electrical connecting terminal comprises a body defining a cavity for accommodating the connecting terminal, and a latch member located in the cavity. The latch member extends from a bottom surface of the cavity toward a top surface of the cavity and includes an opening located proximate the bottom surface of the cavity and a locking portion for locking the connecting terminal within the body.

19 Claims, 4 Drawing Sheets

HOUSING FOR INSTALLING CONNECTING TERMINALS AND A CONNECTOR

CROSS-REFERENCE TO RELATED APPLICATIONS

This application claims priority under 35 U.S.C. § 119 to Chines Patent Application No. 202010709154.3 filed on Jul. 22, 2020, the entire disclosure of which is incorporated herein by reference.

FIELD OF THE INVENTION

The present invention relates to electrical connectors, and more particularly, to a housing for installing connecting terminals.

BACKGROUND

Current positive locking plastic terminal housings utilize a latch structure to enable a quick-plug terminal locking and assembly function. During the assembly process of the quick-plug terminal, the latch structure must be compressed or otherwise deformed to realize the quick-plug terminal insertion action. Current product designs have numerous shortcomings. For example, the insertion force of the quick-plug terminal assembly is often overly-high, and thus not operator friendly. Further, there are typically no mechanical limiting means to the insertion of the quick-plug terminal, and thus there is a risk of over or otherwise incorrect terminal insertion. Finally, existing locking structures have high requirements for the toughness of the raw materials used in their production, which limits material selection and can increase costs.

SUMMARY

A housing for an electrical connecting terminal according to an embodiment of the present disclosure comprises a body defining a cavity for accommodating the connecting terminal, and a latch member located within the cavity. The latch member extends from a bottom surface of the cavity toward a top surface of the cavity, and includes an opening formed therethrough located proximate the bottom surface of the cavity and a locking portion for locking the connecting terminal within the body.

BRIEF DESCRIPTION OF THE DRAWINGS

The invention will now be described by way of example with reference to the accompanying Figures, of which.

DETAILED DESCRIPTION OF THE EMBODIMENTS

Figure 1:
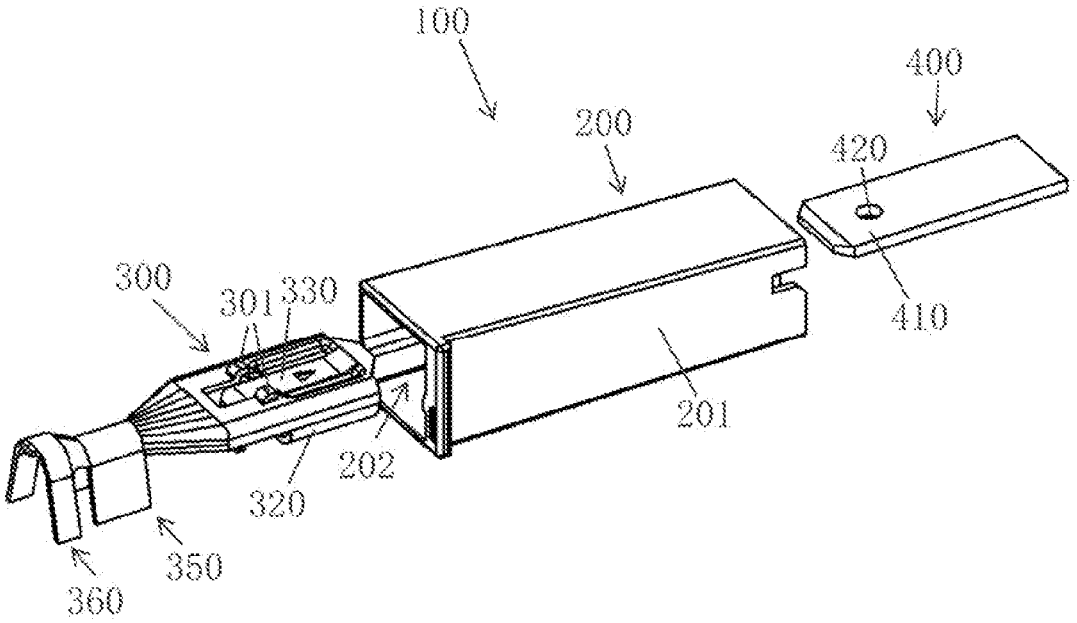
FIG. 1 is an exploded schematic view of a connector according to an embodiment of the present invention.
Figure 2:
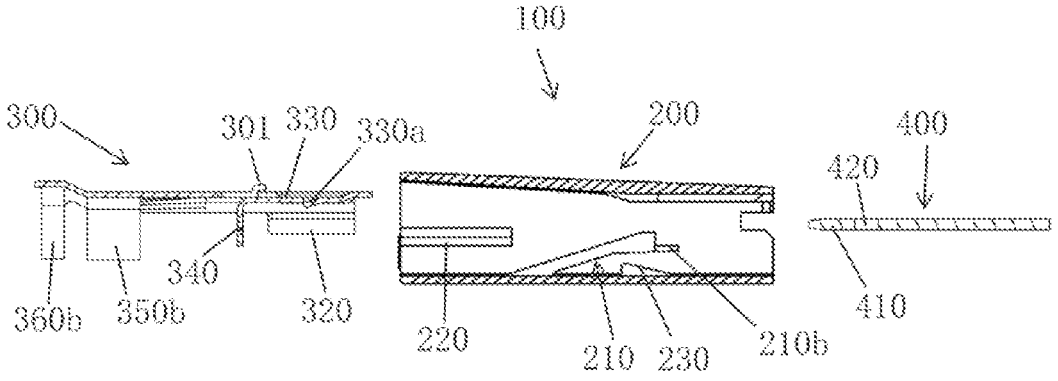
FIG. 2 is a cross-sectional view of the connector of FIG. 1.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

The present invention includes a connector having a connecting terminal, a plug-in terminal, and a housing for installing the connecting terminal. The housing includes a first body having an accommodating cavity, and a latch member located in the accommodating cavity and extending from the bottom surface of the accommodating cavity toward the top surface of the accommodating cavity. The latch member includes an opening located at its root or base proximate the bottom surface of the accommodating cavity which extends through the latch member. The latch member further defines a stepped locking portion for locking the connecting terminal to prevent the connecting terminal from exiting from the housing.

The embodiments of the present invention will be described in detail below with reference to the accompanying drawings.

Figure 3:
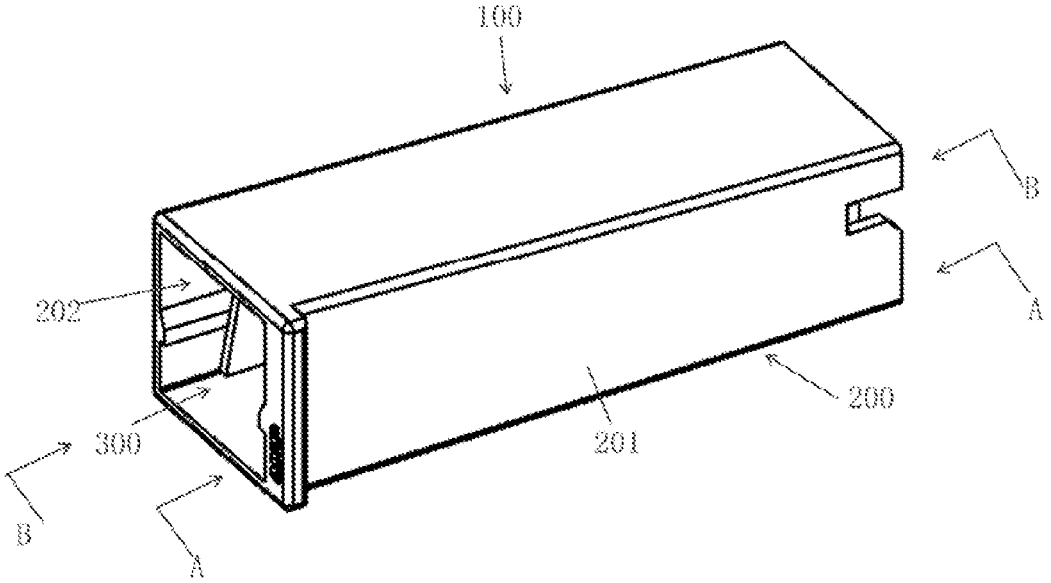
FIG. 3 is a schematic diagram of the connector of FIG. 1 fully assembled.

In the present invention, the front, back, left, right, top, bottom, front end, rear end, left end, right end, upper portion, lower portion, left side, right side, etc. of FIGS. 1-7 are all relative references according to the orientation of FIG. 1. As shown in FIG. 3, it should be understood that the direction of line A-A is the longitudinal direction proximate an outer wall of the illustrated housing, and the direction of line B-B is the longitudinal direction of the center of the overall structure of the housing.

As shown in FIGS. 1-4, a connector 100 according to an embodiment of the present disclosure includes a connecting terminal 300 (e.g., a TE Positive Lock 250 Series terminal), a housing 200 for installing the connecting terminal 300, and a plug-in terminal 400.

Referring generally to FIGS. 1-7, the housing 200 includes a body 201, a pair of latch members 210 and an unlocking member 240. The body 201 has an accommodating cavity 202 for accommodating the connecting terminal 300. Each latch member 210 is located in the accommodating cavity 202 and extends from the bottom surface of the accommodating cavity 202 toward the top surface of the accommodating cavity 202. The unlocking member 240 is located in the accommodating cavity 202 and arranged on the right side of the housing 200. In addition to aiding in unlocking the connecting terminal 300 from the plug-in terminal 400, as set forth in detail herein, the unlocking member 240 may also act as a mechanical stop in the insertion direction during the installation of the connecting terminal 300 into the housing 200.

Figure 6:
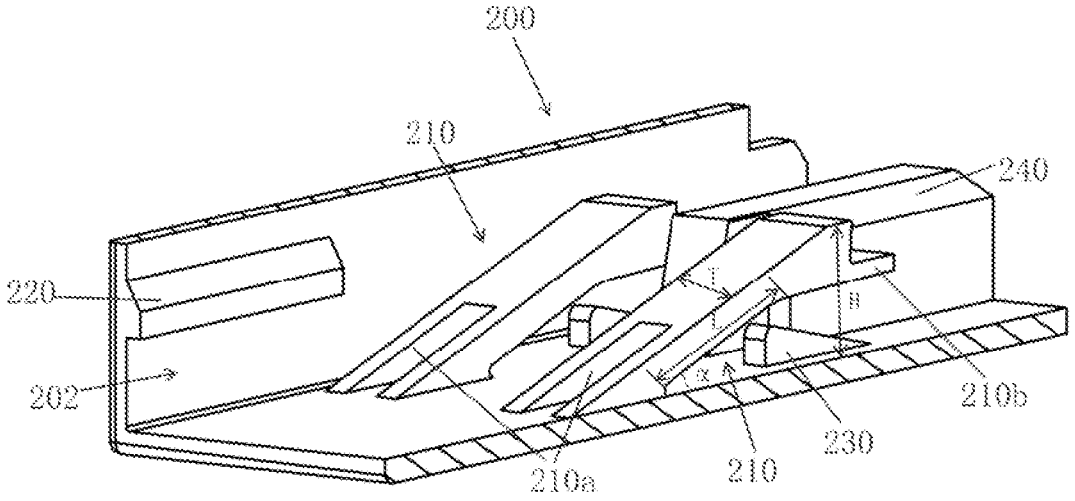
FIG. 6 is a schematic diagram of the housing in FIG. 1 with a top wall and an outer side wall removed.

In the exemplary embodiment, each latch member 210 is an elastic arm defining a through opening or slot 210*a* and a locking portion 210*b*. The opening 210*a* penetrates through a corresponding latch member 210 in the first direction (in the illustrated embodiment, the direction from left to right as shown in FIG. 6) or in the second direction (in the illustrated embodiment, the direction from right to left as shown in FIG. 6). The opening 210*a* is formed at or proximate the base of the latch member where it joins the bottom surface or floor of the accommodating cavity 202. In a preferred embodiment, the opening 210*a* opens or extends to a surface of the floor, with the floor defining a bottom of the opening over its length in the lateral direction.

As shown in FIGS. 2, 4, 5, 6 and 7, the locking portion 210*b* is positioned at the end of the latch member 210 and has a stepped shape. It should be understood that in other embodiments the locking portion 210*b* may be other suitable shapes. As the connecting terminal 300 is inserted into the accommodating cavity 202 from the first direction and installed in place, it first elastically deflects the latch members 210 downward. After sufficient insertion, the locking portion 210*b* elastically returns to lock the connecting terminal 300, preventing its removal from the housing 200. It should be understood that, although the latch member 210 in the illustrated embodiment is present as a pair of components, in another embodiment, the latch member may also be a single component.

As shown in FIGS. 4-7, the latch member 210 is defined with a sloped or ramped shape. The slope of the latch member 210 between its maximum height H and the bottom surface of the accommodating cavity 202 may be constant. The latch member 210 preferably forms an angle $\alpha$ with the bottom surface of the accommodating cavity 202 in the range of 13° to 19°. A length L of a force receiving portion or surface of the latch member 210 ranges from 5.3 mm to 7.1 mm, and the thickness T of the latch member ranges from 0.7 mm to 0.9 mm. Preferably, the range of the angle $\alpha$ is 15° to 18°, the length L ranges from 6.0 mm to 6.5 mm, and the thickness T ranges from 0.75 mm to 0.88 mm. More preferably, the angle $\alpha$ is 17.8°, L is 5.6 mm, and T is 0.85 mm. By forming the latch member 210 with an opening 210*a*, the slope of the latch member may be reduced, the length of the force receiving portion becomes longer, the thickness of the latch member becomes thinner, and the toughness requirements for the material used is reduced.

As shown in FIGS. 1-7, the housing 200 further includes a pair of protrusions or ribs 230 corresponding to the pair of latch members 210. Each rib 230 is located below a corresponding locking member 210, extends in the first direction, and is aligned with a corresponding one of the openings 210*a*. The rib 230 is configured to prevent the latch member 210 from being excessively pressed down or deflected when the connecting terminal 300 is inserted into the accommodating cavity 202, thereby preventing plastic failures.

Also shown in FIG. 1-7, the housing 200 further includes a pair of guides 220 which are symmetrically arranged on both sides of the accommodating cavity and extend in the first direction. The pair of guides 220 are configured to guide the connecting terminal 330 into an appropriate position in the accommodating cavity 202 during insertion. It should be understood that, although the guide in this embodiment is a pair of guides, in another embodiment, the guide may be a single component located on only one side of the accommodating cavity.

Figure 8:
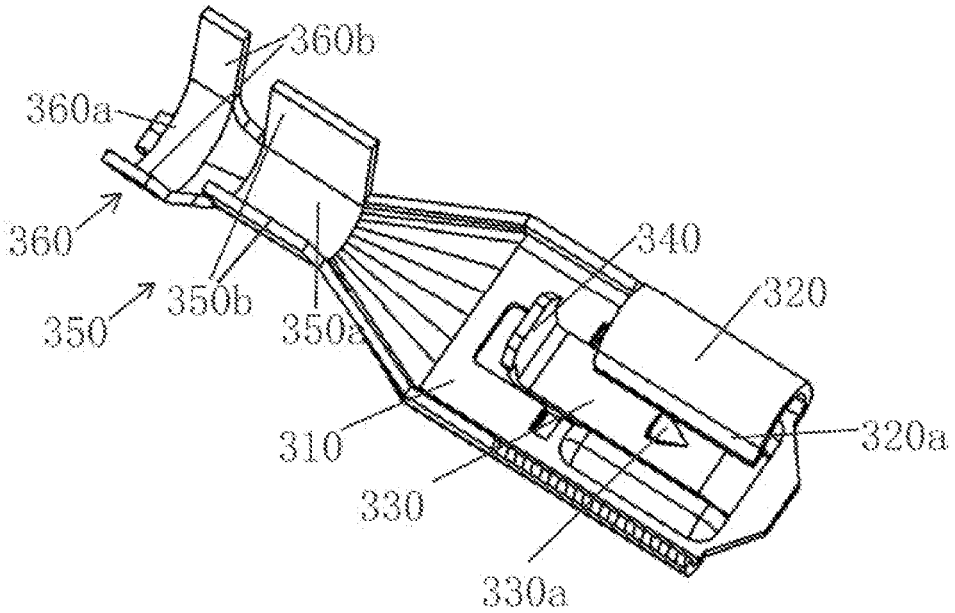
FIG. 8 is a partial cross-sectional view of the crimped portion on a reverse side of the connecting terminal in FIG. 1 with a left side removed.

As shown in FIGS. 1, 2, 4, 6 and 8, the connecting terminal 300 includes a body 310, two crimped portions 320, and a tongue 330. The two crimped portions 320 are formed by crimping oppositely from both sides of the body 310. The tongue 330 extends in the third direction (the direction from left to right along the central axis of the connecting terminal 300), as shown in FIG. 8. Further, a protrusion 330*a* is provided on the tongue 330, and the free end of the tongue 330 is bent upward to form an elastic release portion 340. As shown in FIGS. 1, 2, 4, and 8, the connecting terminal 300 further includes a wire connecting portion 350*a* and a pair of side arms 350*b* provided on the left side of the body 310. The pair of side arms 350*b* are oppositely disposed on the wire connecting portion 350. The connecting terminal 300 is further provided with a wire fixing portion 360 including a fixing portion body 360*a* and a pair of fixing pieces 360*b*, wherein the fixing pieces 360*b* are bent to fix the wire on the fixing portion body 360*a*.

The plug-in terminal 400 includes a plug portion 410 and a through hole 420 formed on the plug portion 410. The plug-in portion 410 may be inserted into the space defined by the body 310 and the crimping portion 320, and is elastically held on the body 310 by a contact portion 320*a* formed at the free end of the crimping portion 320.

Figure 7:
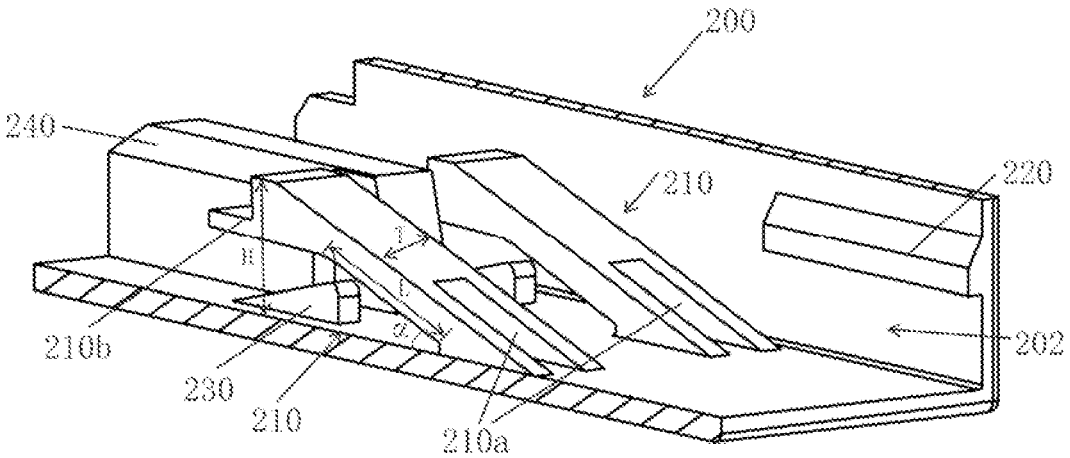
FIG. 7 is a schematic diagram of the housing in FIG. 1 with the top wall and an inner side wall removed.

During assembly of the connector 100, the connecting terminal 300 is first inserted into the accommodating cavity 202 of the housing 200 from the first direction. When the connecting terminal 300 is installed in place, the crimping portion 320 abuts against and is engaged with the stepped portion of the locking portion 210*b* of the latch member 210, thereby preventing the connecting terminal 300 from exiting from the housing 200 in the second direction. Subsequently, the plug-in terminal 400 is inserted into the space defined by the body 310 and the crimping portion 320 from the second direction. As shown in FIGS. 7 and 8, when the plug-in terminal 400 is inserted into the connecting terminal 300, the protrusion 330*a* of the connecting terminal 300 engages with the through hole 420 of the plug-in terminal 400, thereby the plug portion 410 of the plug-in terminal 400 is locked in the connecting terminal 300.

Figure 4:
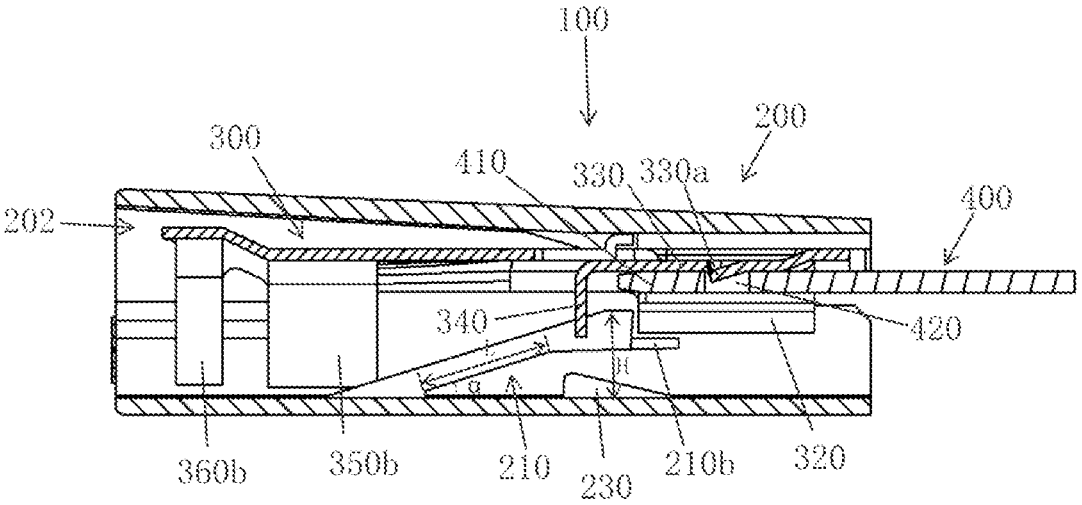
FIG. 4 is a cross-sectional view of FIG. 3 along line A-A.
Figure 5:
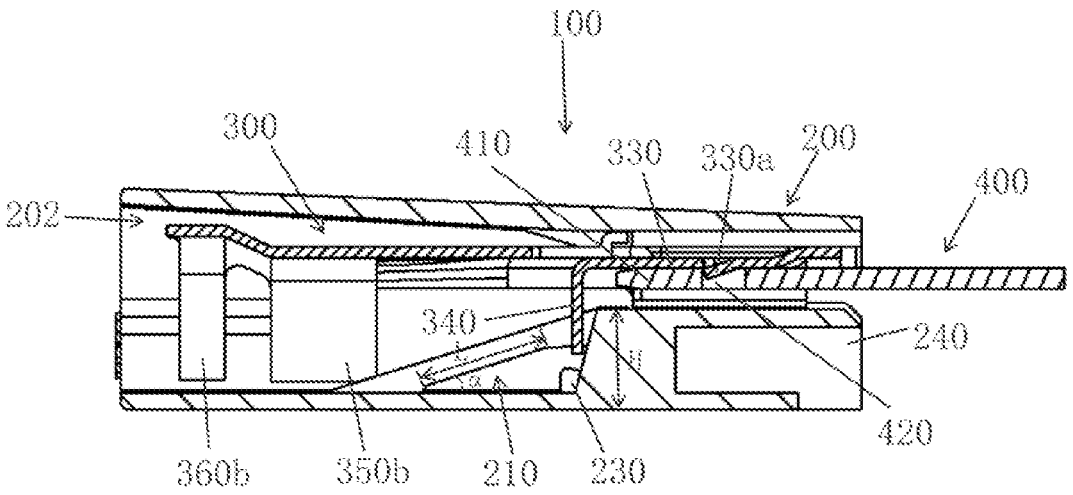
FIG. 5 is a cross-sectional view of FIG. 3 along line B-B.

When the plug-in terminal 400 needs to be disengaged from the connecting terminal 300, the housing 200 and the plug-in terminal 400 are pulled toward the first direction and the second direction, respectively. In the early stage of the pulling process, the plug-in terminal 400 is not movable relative to the connecting terminal 300, but is movable relative to the housing 200 due to the coupling between the protrusion 330*a* and the through hole 420. Thus, the unlocking member 240 is operative to the drive the release portion 340 in the second direction. As shown in FIGS. 4 and 5, as one side of the unlocking member 240 is at an inclined angle with the vertical surface (as shown in FIG. 5), when the unlocking member 240 contacts the release portion 340 during the pulling process, the side inclined surface of the unlocking member 240 urges the release portion 340 to move upward and drives the tongue 330 to offset upward. This disengages the protrusion 330*a* on the tongue 330 from the through hole 420 of the plug-in terminal 400, thereby allowing the plug-in terminal 400 to be detached from the connecting terminal 300 as the pulling process progresses.

The above described assembly according to embodiments of the present disclosure provides several advantages over those of the prior art. For example, the housing provided by the present invention has an opening at the root or base of the latch member, which reduces the insertion force of the quick-plug terminal during assembly, reduces the difficulty of assembly operation, reduces the toughness requirements for raw materials, thus expanding the available selection range of materials. It is noted that the placement of the opening at the base of each latch member more effectively achieves the above benefits. Further, the ribs can be used to prevent the latch member from being excessively pressed down to cause failure. The openings in the latch members also aid in the ability to form the ribs during an injection molding process. Further still, the guide(s) effectively prevent the mis-insertion of the terminals, thus increasing production efficiency.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A housing for an electrical connecting terminal, comprising:

a body defining a cavity for accommodating the connecting terminal;

a latch member located in the cavity and extending from a bottom surface of the cavity toward a top surface of the cavity, the latch member including:

an opening extending through the latch member; and a locking portion for locking the connecting terminal within the body, the locking portion defining a stepped shape formed on an end of the latch member opposite the bottom surface of the cavity.

2. The housing of claim 1, wherein the latch member includes an elastic arm inclining in a direction of insertion of the connecting terminal, the opening located proximate the bottom surface of the cavity.

3. The housing of claim 2, wherein the latch member includes a pair of elastic arms.

4. The housing of claim 1, further comprising a protruding guide extending along a side of the cavity for guiding the connecting terminal into position within the cavity.

5. The housing of claim 1, wherein the locking portion defines a stepped shape formed on an end of the latch member opposite the bottom surface of the cavity.

6. The housing of claim 1, wherein the body further defines an unlocking member protruding into the cavity for disengaging a plug-in terminal installed in the connecting terminal.

7. The housing of claim 6, wherein the unlocking member includes a surface inclining in a direction of insertion of the connecting terminal.

8. The housing of claim 1, wherein:

the latching member forms an angle with the bottom surface of the cavity ranging from 13° to 19°;

a length of a force receiving portion of the latch member ranges from 5.3 mm to 7.1 mm; and a thickness of the latch member ranges from 0.7 mm to 0.9 mm.

9. A housing for an electrical connecting terminal, comprising:

a body defining a cavity for accommodating the connecting terminal;

a latch member located in the cavity and extending from a bottom surface of the cavity toward a top surface of the cavity, the latch member including:

an opening extending through the latch member; and a locking portion for locking the connecting terminal within the body;

wherein the latch member includes an elastic arm inclining in a direction of insertion of the connecting terminal, the opening located proximate the bottom surface of the cavity; and the housing further comprises a protruding rib positioned in the cavity and below the latch member, the rib limiting the downward deflection of the latch member as the connecting terminal is inserted into the cavity.

10. The housing of claim 9, wherein the rib is aligned with the opening in the latch member in the direction of insertion of the connecting terminal.

11. A connector, comprising:

a connecting terminal;

a housing retaining the connecting terminal, the housing defining a cavity and a latch member located in the cavity and extending from a surface of the cavity, the latch member including:

an opening extending through the latch member;

a locking portion for locking the connecting terminal within the housing; and a plug-in terminal for selectively engaging with the connecting terminal, the locking portion having a stepped shape formed on a free end of the latch member.

12. The connector of claim 11, wherein the latch member includes a pair of elastic arms extending in a direction of insertion of the connecting terminal.

13. The housing of claim 12, further comprising a pair of ribs positioned in the cavity and below each of the elastic arms, the ribs defining a face inclining in a direction opposite to that of the elastic arms.

14. The connector of claim 11, further comprising a pair of guides extending along each side of the cavity for guiding the connecting terminal into position in the cavity during insertion.

15. The connector of claim 11, wherein the opening is centered over a thickness of the latch member and is partially defined by a bottom surface of the cavity.

16. A connector, comprising:

a connecting terminal;

a housing retaining the connecting terminal, the housing defining a cavity and a latch member located in the cavity and extending from a surface of the cavity, the latch member including:

an opening extending through the latch member;

a locking portion for locking the connecting terminal within the housing; and a plug-in terminal for selectively engaging with the connecting terminal;

wherein:

the latching member forms an angle with the bottom surface of the cavity ranging from 18° to 15°;

a length of a force receiving portion of the latch member ranges from 6.0 mm to 6.5 mm; and a thickness of the latch member ranges from 0.75 mm to 0.88 mm.

17. The connector of claim 12, A connector, comprising:

a connecting terminal;

a housing retaining the connecting terminal, the housing defining a cavity and a latch member located in the cavity and extending from a surface of the cavity, the latch member including:

an opening extending through the latch member;

a locking portion for locking the connecting terminal within the housing; and a plug-in terminal for selectively engaging with the connecting terminal;

wherein the body defines an unlocking member arranged at least partially between the pair of elastic arms and adapted to disengage the plug-in terminal from the connecting terminal.

18. The connector of claim 17, wherein the unlocking member includes a portion inclining in a direction of insertion of the connecting terminal.

19. The connector of claim 18, wherein the connecting terminal includes:

a body;

two crimping portions; and a tongue, the tongue having an upwardly bent end defining a release portion, the release portion oriented adjacent the inclined portion of the unlocking member with the connecting terminal installed in the housing.

* * * * *